US006248019B1

(12) United States Patent
Mudie et al.

(10) Patent No.: US 6,248,019 B1
(45) Date of Patent: Jun. 19, 2001

(54) AMUSEMENT APPARATUS FOR A SHOOTING GAME WITH SUCCESSIVE POTENTIAL SCORING EMISSIONS

(75) Inventors: Robert Walter Mudie, Victoria (AU); Jonathan Michael Plache, Surrey (GB)

(73) Assignee: Cormorant Properties Limited (GB)

( * ) Notice: Subject to any disclaimer, the term of this patent is extended or adjusted under 35 U.S.C. 154(b) by 0 days.

(21) Appl. No.: 09/315,257

(22) Filed: May 20, 1999

(30) Foreign Application Priority Data

May 21, 1998 (GB) ..... 9810816
Nov. 7, 1998 (GB) ..... 9824360

(51) Int. Cl.[7] ..... F41J 5/02
(52) U.S. Cl. ..... 463/49; 463/51; 463/52
(58) Field of Search ..... 463/49–57, 5; 434/11, 22–25

(56) References Cited

U.S. PATENT DOCUMENTS 3,898,747 * 8/1975 Marshall ..... 434/22
3,995,376 * 12/1976 Kimble et al. ..... 434/22
4,533,144 * 8/1985 Juarez et al. ..... 463/5
4,695,058 * 9/1987 Carter, III et al. ..... 463/5
4,772,028 * 9/1988 Rockhold et al. ..... 463/5
4,898,391 * 2/1990 Kelly et al. ..... 463/5
4,938,483 * 7/1990 Yavetz ..... 463/5
5,090,708 * 2/1992 Gerlitz et al. ..... 463/5
5,320,358 * 6/1994 Jones ..... 273/371
5,320,362 * 6/1994 Bear et al. ..... 463/5
5,375,847 * 12/1994 Fromm et al. ..... 463/5
5,741,185 * 4/1998 Kwan et al. ..... 463/51
5,785,592 * 7/1998 Jacobsen ..... 463/7
5,788,500 * 8/1998 Gerber ..... 434/22
5,904,621 * 5/1999 Small et al. ..... 463/52

FOREIGN PATENT DOCUMENTS

0619130 * 10/1994 (EP) .

* cited by examiner

*Primary Examiner*—Michael O'Neill
*Assistant Examiner*—John M Hotaling, II
(74) *Attorney, Agent, or Firm*—Ware, Fressola, Van Der Sluys & Adolphson LLP

(57) ABSTRACT

Apparatus for playing amusement games comprising a plurality of player units 18 having an emitter 27 for emitting a directed beam, means for timing 23 and indicating to the players 24, 25 successive potentially scoring emissions from the emitter 27. The apparatus includes targets 31, which may include player units. The player units include means for indicating that they are timing an emission 105 for example by a flashing light and/or an audible signal. The targets 31 react to receipt of potentially scoring emissions and react differently to some potentially scoring emissions than to others, particularly where the players and their player units are arranged in teams. The player units include memories for memorising the events in which they are concerned in the game, and from which other player units they are received. Similarly the target devices can store their events. The emitters 26 emit light beams either of infra-red light or visible light. The beams are modulated to identify which particular emitter device is emitting which beam.

47 Claims, 3 Drawing Sheets

AMUSEMENT APPARATUS FOR A SHOOTING GAME WITH SUCCESSIVE POTENTIAL SCORING EMISSIONS

TECHNICAL FIELD

The present invention relates to apparatus for playing amusement games.

BACKGROUND OF THE INVENTION

Laser tag games are known, which employ laser guns and targets receptive to being "hit" by the laser guns. Players score by hitting the targets.

The targets in laser tag games are often worn by other players. This can be unacceptable to some people. However, games involving inanimate targets can lack amusement value due to low levels of skill being required to play.

SUMMARY OF THE INVENTION

The object of the invention is to provide apparatus for playing improved amusement games.

According to the invention there is provided apparatus for playing amusement games, the apparatus comprising:

a plurality of player units adapted for direction by players, each unit having:

an emitter for emitting a directed beam, means for timing successive potentially scoring emissions from the emitter and means for indicating to the player a count-down to each potentially scoring emission.

In use, the emissions may be directed to other players and/or to other targets. Thus each player unit may be adapted to receive a potentially scoring emission from another player unit. Alternatively or additionally, the apparatus may include at least one target device for receiving potentially scoring emissions.

Where the player units are adapted to receive potentially scoring emissions, they preferably include means for indicating that they are in an active state, i.e. in the process of timing an emission which will be counted down. This indicating means can be a flashing light and/or an audible signal.

Similarly, the target devices can be adapted to react to receipt of potentially scoring emissions. They may be adapted to react differently to some potentially scoring emissions than to others, particularly where the players and their player units are arranged in teams.

In the preferred embodiments, the player units include memories for memorising the events in which they are concerned in the game, e.g. number of potentially scoring emissions made and received, and from which other player units they are received. Similarly the target devices can store their events.

Typically the count-down means will be a loud speaker, although it could be a visual display.

Preferably, the emitters will emit light beams, which may be of visible light or infra red light. The beams can be emitted with wide beams or narrow beams. Typically wide beams will be of infra-red light from LED emitters and narrow beams will be of visible light from laser emitters.

Normally the beams will be modulated to identify which particular emitter device is emitting which beam. Emission of the beams can be continuous with its modulation being altered at the potential score times. Alternatively, emission of the beam can be intermittent and occur only at the potential score times.

Where the emission is continuous, it can be modified prior to the potential score times to give a warning to target devices enabling them to take evasive action.

In one type of embodiment, each player unit counts down successively. In either type, the interval between its potentially scoring emissions can be varied in accordance with a number of parameters, including a handicap and the players success or failure during the game. Randomly or regularly introduced "misfires" can be introduced, whereby a potentially scoring emission does not occur.

In another type of embodiment, the player units are intended to be carried and simulate balls, being illuminated prior to emission on count down. On emission their illumination is extinguished, but another will illuminate if it has received an emission.

The player units may be equipped with controls, particularly a "tackle" control for causing an extra emission for blocking an emission from one other unit and/or its reception by a different other unit. Another envisaged control is an "interception" or "catch" control, which must be activated in order to allow a potentially scoring emission to be received by the player unit concerned.

In the second type, the player units will normally be hand held; whereas in the first type they will normally not be hand held. However, if they are to be carried by a player, it is preferred that they be adapted to be carried on another part of a player's body such as a shoulder or the head. This can have a variety of advantages, such as reducing the risk of harm to players in collision, and/or requiring players to perform more whole body movement to aim their emitter devices, and/or enabling players to aim whilst using their hands for other tasks.

Alternatively, the player units can be adapted to be vehicle mounted on floats, boats, bicycles, go-karts etc.

In addition to the player units directed by the players, some or all of the targets can be provided with emitter devices, which may also be controlled to emit on count-down. Alternatively, these emitters may be controlled to emit only in response to receiving emission from a player unit.

The target devices may be movable, for instance being carried on players. However, it is preferred that they be fixed or at least mechanically movable. When mechanically movable, they can be adapted to move in or out of hiding from the view of players. The movement can be caused by receipt of warning emission for more than a certain period prior to the potential score times.

The targets can be inert, registering scores each time they receive a potentially scoring emission. They indicate that they have registered a score in any of a variety of ways, particularly by illumination, sound or collapse. They can be inactivated for a certain period, the inactivation being general or to the particular emitter device for which they have just registered a score.

The targets can be arranged within a play area, but will normally be arranged peripheral to it.

For scoring a game, the scores on targets can be communicated to a control unit by hardwiring or wireless transmission such as ultrasonic, radio or infrared transmission. Alternatively the individual targets can be adapted to transmit back to the player units when one of the former has registered a score from one of the latter. The player units can be adapted to down load their scores at the end of each game.

In addition to transmitting back a score, the targets or some of them, may emit to the player a signal which gives him a specific property for a predetermined period of time, such as invincibility to emission from other players.

BRIEF DESCRIPTION OF THE DRAWINGS

To help understanding of the invention, two specific embodiments thereof will now be described by way of example and with reference to the accompanying drawings, in which.

BEST MODE FOR CARRYING OUT THE INVENTION

Figure 1:
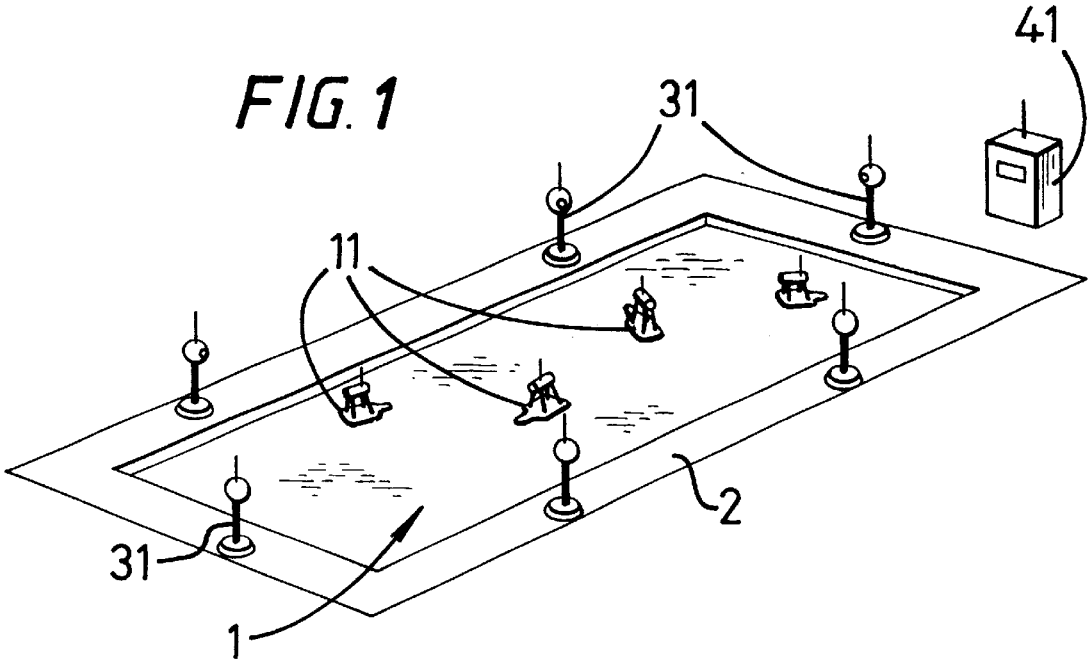
FIG. 1 is a perspective view of a swimming pool with amusement apparatus according to the invention of the first type.
Figure 2:
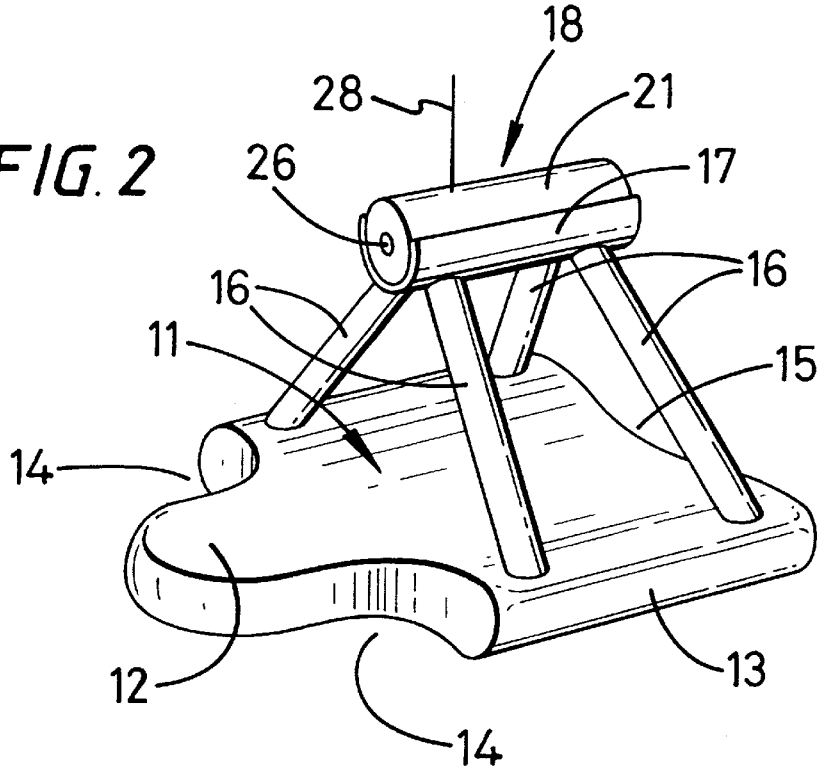
FIG. 2 is a more detailed perspective view of an emitter float of the invention.
Figure 3:
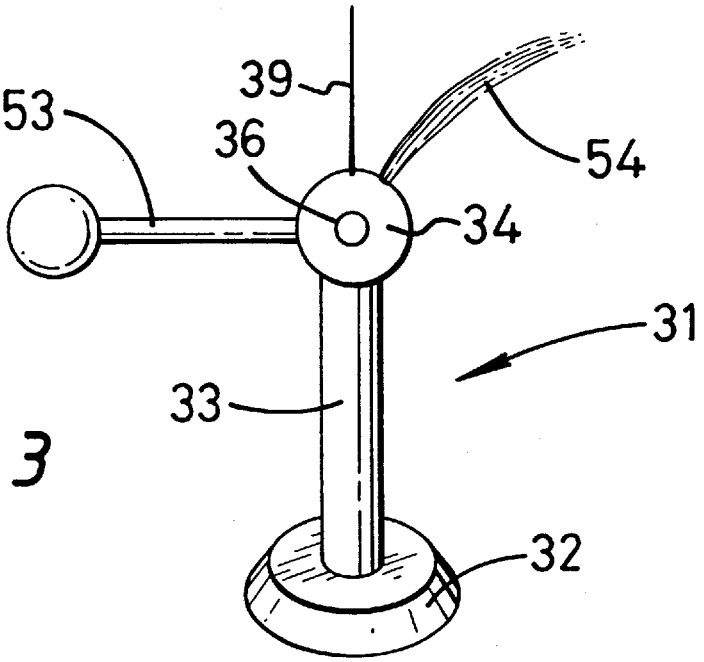
FIG. 3 is a similar view of a target of the invention.
Figure 4:
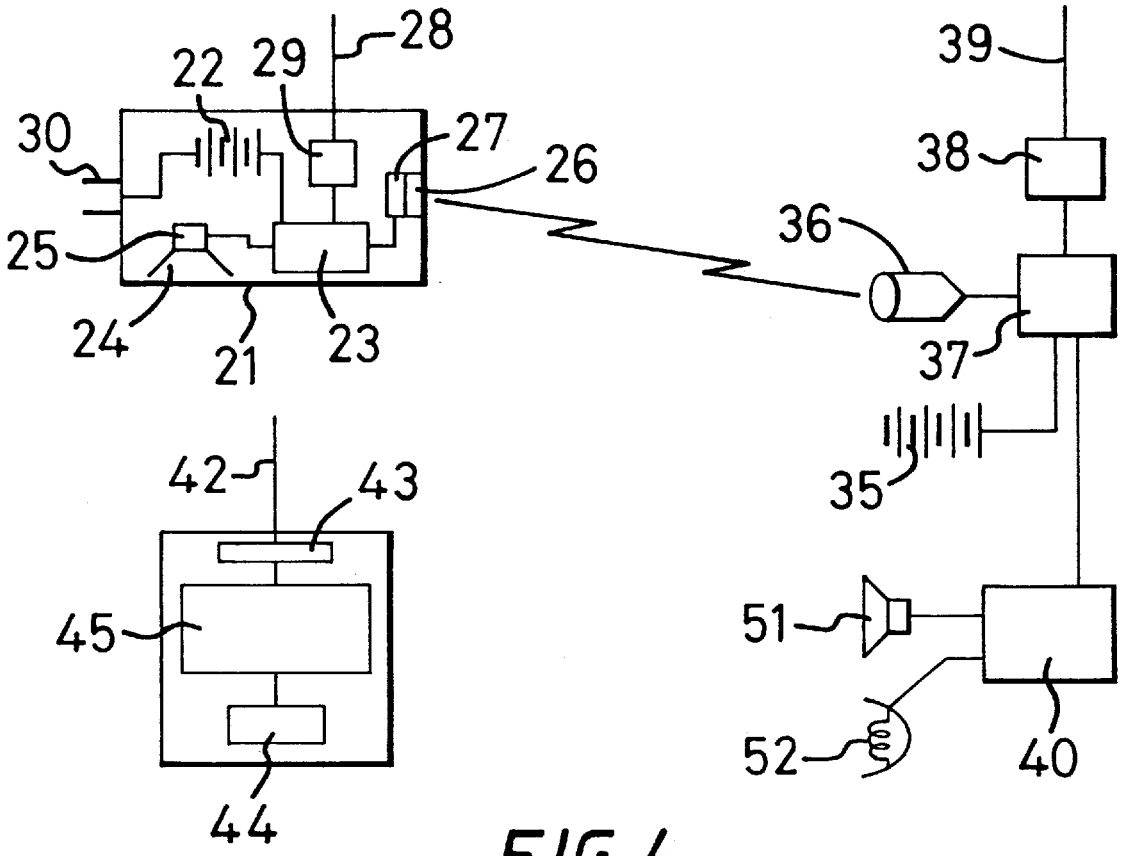
FIG. 4 is a block diagram of the apparatus.

Referring to the drawings, the amusement apparatus comprises a number of floats 11 shown on a swimming pool 1 and a number of targets 31 mounted on the swimming pools surround 2. The floats and the targets are all in radio communication with a base station 41.

Each float 11 is generally dish shaped for a player to lie in. It has a "bow" 12 on which he/she can rest his chin if tired. Sides 13 of the float stop short of the shoulder area 14 so that the player can manoeuvre the float with his arms in the water. Equally the "stern" 15 stops short of the thigh area so that the player can use his legs also to manoeuvre the float. From the sides, four posts 16 extend up and meet in a cradle 17 for an player unit 18.

This comprises a casing 21 housing a battery pack 22, a control circuit 23, a loudspeaker 24 and a loudspeaker drive circuit 25, a laser 26 and a laser drive circuit 27, an aerial 28 and a communication circuit 29. For charging the battery pack has two surface contacts 30; the emitter device is demountable from its cradle 17 and fitted to a charging cradle—not shown. The device has an ON/OFF switch.

Each target 31 has a base 32, a post 33 and a photoreceptor head 34. The target also includes a battery 35, but insofar as the target is essentially stationary, though portable, the battery can be large and have a long life in comparison with that of the emitter devices. The head includes a photoreceptor 36 as such, a decoder circuit 37, a communication circuit 38, an aerial 39 and a reaction drive circuit 40. The length of the posts is such that the player units and the photoreceptors are at the same height.

The base station 41 has an aerial 42, a receiver 43, a decoding and display control microprocessor 44 and a display 45.

In use, several of the floats are launched on the swimming pool with a player on each. At the beginning of the game, the base station emits a "GO" signal and each of the player units generates a "GO" signal to its loudspeaker which the player can hear. He then attempts to align himself with a target. As time progresses, at three seconds from a predetermined firing time, each unit's loudspeaker is caused to count down:

"Three, two, one, fire".

On "Fire", the laser is switched ON and transmits a modulated identifying signal, which is received by any of the targets' photoreceptors with which it is aligned. A corresponding "Hit by player unit X" signal is sent to the base station. The target reacts by powering of the reaction circuit, which may sound a horn 51, illuminate a light 52, swing an arm 53, squirt a fountain 54 or the like.

Thereafter, each player's unit counts down and fires on a regular basis. The apparatus can be provided, at the microprocessor, with a protocol disabling the same target from being activated by the same emitter for a certain period or at all or any suitable combination.

If the player units' lasers are switched on permanently, they can be more readily aimed. However, the targets may be adapted to react only if illuminated during the last second for instance of the count down. Further, if the post is provided with a motor for rotating it about its axis, the target may be adapted to turn away if illuminated for too long during a count down.

The microprocessor may have inputs enabling the player units to be handicapped, whereby certain of them are controlled to count down more or less often. Alternatively or additionally, the player units can be controlled to "Misfire", that is not emit normally more or less frequently. Other events characteristics of the units can be changed, such as range and beam width. In particular, these can changed in accordance with the players success so far and/or handicap in the game.

In a non-illustrated embodiment, the floats themselves are equipped with photoreceptor heads and the other circuitry of the targets, so that they can act as targets.

The invention is not intended to be restricted to the details of the above described embodiment. In a land based version of the apparatus, the player units can be shoulder mounted on vests worn by players. Two different emitters can be provided, one on one shoulder and the other on the other shoulder. One can be a laser requiring accurate aiming—by its own light (which will be a lower power, non-blinding laser)—and the other can be a diffuse device requiring less accurate aiming, such as an infra red emitter. Further, the emitters could combine both laser and infrared devices adapted to emit simultaneously.

Some targets can be receptive to one emitter, some to the other and some again to both. The vest may be provided with buttons for choosing which emitter will be counted down next. Other buttons may invoke attributes which have been gathered, such as invincibility for a period in accordance with the score gathered.

Figure 5:
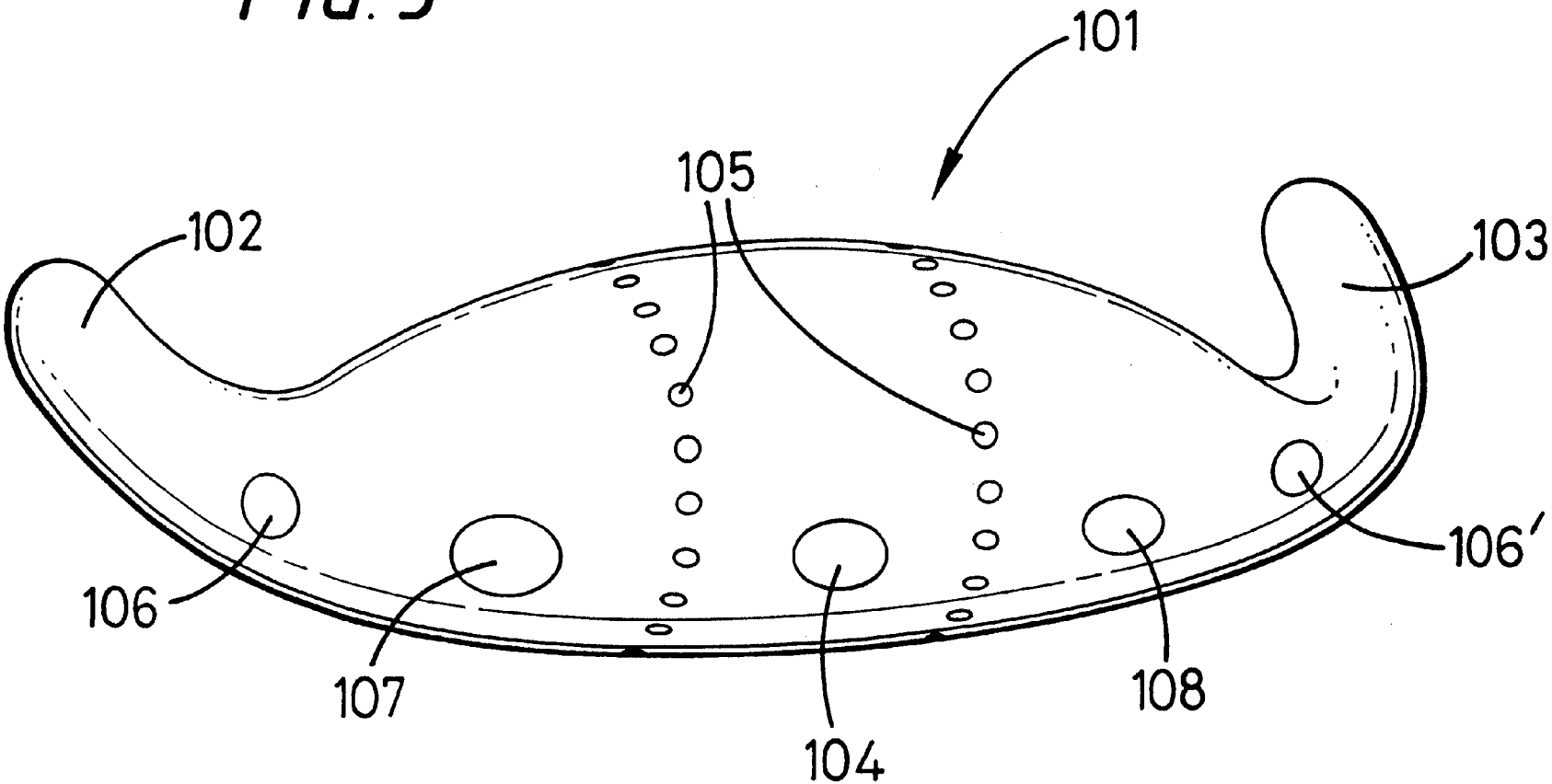
FIG. 5 is a perspective view of a player unit of the other type.

Turning now to FIG. 5, the player unit there shown simulates a rugby ball 101 and is referred to as an orb. It is adapted to be held at its ends 102,103. In the middle of its front, it has a laser emitter 104; and in two rings around it there are provided LEDs 105 for its illumination. Two control buttons 106, 106' are provided at its respective ends 102,103. A speaker 107 is provided towards one end and a receptor 108 is provided towards the other end.

In use, all the players of two teams each have one of the orbs. Targets such as 31 in FIG. 1 are provided at each end of a playing area. A game is initiated by a captain of one team presenting his orb to the back of his team's target, where it receives an emission via its receptor such as cause the orb to start flashing, by the LEDs, and count down. The captain must pass the activity represented by the flashing of his orb to another of his team. For this the orb is directed at another player's orb at the time of emission following count down. The other orb then flashes and its activity is passed on. The objective is to be able to pass the activity to the other team's target, thus scoring. The opposing team's captain can then restart the game in the same manner as before. The game continues for a set time and is scored in accordance with the greatest number of receptions made at the respective targets.

The other team seek to intercept the activity by one of their team receiving it. This is aided by the "tackle" buttons 106, which can inhibit reception at an opposing orb and allow reception at the tackling orb. The optional interception or "catch" buttons 106' must be activated when provided to allow reception by the orb, when passed from another orb. The tackle buttons also are optional and/or can be deactivated at will.

A feature of the game is that the activity can be lost without passing on, in which case the opposite team from the one losing the activity gains a score. Also the activity can divide where two orbs both receive the activity.

In an alternative, as opposed the count down being audible, it can be indicated by an increasing frequency of the LEDs of the orb about to transmit. The game can be played by a number of players acting individually as opposed to in two teams.

We claim:

1. Apparatus for playing amusement games, said apparatus comprising;

a plurality of player unit means adapted for direction by players, each player unit means having;

an emitter means for emitting a directed beam, said emitter means having;

means for timing successive potentially scoring emissions from said emitter means, and means for indicating to a player a count-down to each potentially scoring emission;

whereby the emitter means emits a potentially scoring emission at the end of said count-down indication.

2. Apparatus according to claim 1, wherein said apparatus further includes at least one target device for receiving potentially scoring emissions, said target devices being adapted to react to receipt of said potentially scoring emissions.

3. Apparatus according to claim 2, wherein said target devices further include memories for memorising events, in particular receipt of potentially scoring emissions.

4. Apparatus according to claim 1, wherein said count-down means includes a loud speaker.

5. Apparatus according to claim 1, wherein said count-down means includes a visual display.

Apparatus according to claim 1, wherein said emitters emit light beams.

6. Apparatus according to claim 1, wherein said emitter means emit light beams.

7. Apparatus according to claim 6, wherein each emitter means is an LED emitter adapted to emit wide beams of infra-red light.

8. Apparatus according to claim 6, wherein each emitter means includes a laser emitter adapted to emit narrow beams of visible light.

9. Apparatus according to claim 6, wherein each emitter means includes means for modulating said light beams to identify which particular emitter means is emitting which beam.

10. Apparatus according to claim 9, wherein said emitting means are adapted to emit continuously and said modulation means is adapted to alter said modulation at potential score times.

11. Apparatus according to claim 10, wherein said modulation means is adapted to modify the modulation prior to the potential score times to warn target devices to enable them to take evasive action.

12. Apparatus according to claim 9, wherein said emitting means are adapted to emit intermittently at said time for potentially scoring emissions.

13. Apparatus according to claim 1, wherein each emitter means is adapted to count down successively.

14. Apparatus according to claim 1, wherein each emitter means is adapted such that the interval between potentially scoring emissions is varied in accordance with a number of parameters, including a handicap and said players success or failure during said game.

15. Apparatus according to claim 1, wherein each emitter means is adapted to introduce random "misfires", whereby a potentially scoring emission does not occur at the end of said count-down.

16. Apparatus according to claim 1, wherein said player units are adapted to be carried on part of said player's body such as a shoulder or head.

17. Apparatus according to claim 1, wherein said player units are adapted to be vehicle mounted on floats.

18. Apparatus according to claim 1, wherein said player units are adapted to be vehicle mounted on boats.

19. Apparatus according to claim 1, wherein said player units are adapted to be mounted on bicycles.

20. Apparatus according to claim 1, wherein said player units are adapted to be mounted on go-karts.

21. Apparatus according to claim 2, wherein said target devices are adapted to be movable.

22. Apparatus according to claim 21, wherein said target devices are adapted to be carried on players.

23. Apparatus according to claim 21, wherein said target devices are adapted to be movable mechanically.

24. Apparatus according to claim 23, wherein said target devices are adapted to move in or out of hiding from view of said players.

25. Apparatus according to claim 24, wherein said target devices are adapted to move upon receipt of warning emission for more than a certain period prior to said time for potentially scoring emissions.

26. Apparatus according to claim 2, wherein said target devices are adapted to be fixed in position and to register scores each time they received said potentially scoring emission.

27. Apparatus according to claim 26, wherein at least one of said target devices is adapted to react to registration of said potentially scoring emission by illuminating.

28. Apparatus according to claim 26, wherein at least one of said target devices is adapted to react to registration of said potentially scoring emission by emitting a sound.

29. Apparatus according to claim 26, wherein at least one of said target devices is adapted to react to registration of said potentially scoring emission by collapsing.

30. Apparatus according to claim 2, wherein said target devices are adapted to be inactivated for a certain period after receiving said potentially scoring emission, said inactivation being general to all the emitter means.

31. Apparatus according to claim 2, wherein said target devices are adapted to be inactivated for a certain period after receiving said potentially scoring emission, said inactivation being to a particular emitter means for which they have received a score.

32. Apparatus according to claim 2, wherein said target devices are adapted to transmit scores to a control unit by hardwiring.

33. Apparatus according to claim 2, wherein said target devices are adapted to transmit scores to a control unit by wireless transmission.

34. Apparatus according to claim 2, wherein said target devices further include emitters and are adapted to emit to said player units when one of the former has registered a score from one of the latter.

35. Apparatus according to claim 34, wherein said emission from said target is adapted to give said player unit a specific property for a predetermined period of time.

36. Apparatus according to claim 35, wherein said specific property is invincibility from other player units.

37. Apparatus according to claim 1, wherein said player units are adapted to down load their scores at the end of each game.

38. Apparatus according to claim 1, wherein each player unit is adapted to receive said potentially scoring emission from another player unit.

39. Apparatus according to claim 38, wherein each player unit further includes means for indicating that they are in an active state of emitting.

40. Apparatus according to claim 39, wherein said indicating means is a flashing light.

41. Apparatus according to claim 39, wherein said indicating means is an audible signal.

42. Apparatus according to claim 38, wherein said player units include memories for memorising events in which they are concerned in said game.

43. Apparatus according to claim 38, wherein each player unit is a simulated ball, adapted to be carried and is illuminated prior to emission on said count-down to each potentially scoring emission and on emitting a potentially scoring emission the illumination is extinguished.

44. Apparatus according to claim 43, wherein each player unit is adapted to be illuminated upon reception of an emission.

45. Apparatus according to claim 38, wherein each player unit further includes a "tackle" control for causing an extra emission for blocking an emission from another player unit.

46. Apparatus according to claim 38, wherein each player unit further includes a "tackle" control for causing an extra emission for blocking reception of an emission by a different another player unit.

47. Apparatus according to claim 38, wherein each player unit further includes an "interception" or "catch" control, which must be activated in order to allow said potentially scoring emission to be received by said player unit concerned.

* * * * *